United States Patent [19]

Juang

[11] Patent Number: 4,461,271

[45] Date of Patent: Jul. 24, 1984

[54] PORTABLE GAS FIRING APPARATUS

[76] Inventor: Bor L. Juang, 7, La. 43, Min-Juu Rd., Hsinchu, Taiwan

[21] Appl. No.: 370,153

[22] Filed: Apr. 21, 1982

[51] Int. Cl.[3] ..... F24C 5/20; F23Q 2/00

[52] U.S. Cl. ..... 126/38; 222/5; 431/142; 431/344

[58] Field of Search ..... 126/38, 39 R, 39 M, 126/39 B, 9 R, 9 A, 9 B, 25 R, 29, 30; 431/142, 344; 222/5, 3

[56] References Cited

U.S. PATENT DOCUMENTS

| | | | |
|---|---|---|---|
| 1,390,265 | 9/1921 | Allen | 431/344 |
| 2,853,126 | 9/1958 | Corlet | 126/38 |
| 2,890,815 | 6/1959 | Corlet | 431/142 |
| 3,267,700 | 8/1966 | Kommer | 431/142 |
| 3,620,660 | 11/1971 | Laurent | 431/344 |
| 3,907,490 | 9/1975 | Schaller | 431/142 |
| 4,043,744 | 8/1977 | Svensson | 431/142 |
| 4,192,284 | 3/1980 | Vache | 126/38 |
| 4,284,058 | 8/1981 | Lutz | 126/38 |

*Primary Examiner*—Daniel J. O'Connor

*Attorney, Agent, or Firm*—Birch, Stewart, Kolasch & Birch

[57] ABSTRACT

An improvement in construction of a casing of a gas firing cooking apparatus which has elements, such as, a burner, control means for gas delivery to the burner, igniter, gas take-off head, etc., superposed on a removable gas cartridge and a surrounding casing with two chambers for separately receiving the superstructure and gas cartridge. An open end is provided at the bottom of the casing for easy access to the casing. A flexible springy member is disposed across the open end with one end thereof pivoted to the open end and other end thereof releasably fastened to the open end for clamping the gas cartridge against the gas take-off head to establish a gas-tight connection.

3 Claims, 3 Drawing Figures

PORTABLE GAS FIRING APPARATUS

BACKGROUND OF THE INVENTION

This invention relates to a portable gas firing apparatus, for cooking, heating, etc.. More particularly, to an apparatus having a gas firing system superposed on a detachable pressure gas cartridge which can be removed for replacement after the gas is consumed.

Portable gas firing apparatus are cooperatively assembled with a box-like container and commonly used by people when going picnic, camping, mountaineering, etc. In U.S. Pat. No. 3,907,490 there is disclosed a kind of gas firing apparatus in which the gas firing system and gas cartridge are respectively disposed inside two chambers divided by a common partition that horizontally passes across a container. The gas firing system can include a burner upwardly extending from the common partition, a control member for gas delivery to the burner, an ignition device, a gas take-off head, etc. The lower bottom portion of the container is constituted by a bowl-like portion which is threadedly attached to an enclosure downwardly extending from the common partition to cooperatively form the lower chamber in which the gas cartridge is held clamped against an annular sealing member of the gas take-off head and kept in a gas-tight connection with the gas take-off head by an upward pressure induced upon full-thread-depth screw action of the bowl-like portion. This screw action not only establishes a gas-tight connection between the gas cartridge and gas take-off head but also forces the top side of the gas cartridge against an axial finger in the form of a sharp spike which is disposed in a slightly projected position in the gas take-off head so that the gas cartridge is perforated by said finger for the excape of the gas to the burner through the gas take-off head.

It has been discovered that gas may leak at the connection between the gas take-off head and the gas cartridge when uncovering the box-like container. A user may wrongly take off the lid by applying a spiral force, instead of by applying an axial pulling force. The spiral force causes the screwed bottom bowl portion to spirally move in a direction departing from the gas take-off head and thereby reduces the upward pressure used to maintain the gas-tight connection.

In some cases, the gas take-off head fails to permit the escape of the gas. The finger may be positioned in a tight fit, relative to the perforation drilled by itself, that will be maintained rigidly at the end of the screw action.

SUMMARY OF THE INVENTION

According to the invention a portable gas firing apparatus for cooking, heating, etc., is provided having a casing divided into two chambers with one disposed above the other. A common partition of the two chambers is provided with an upwardly extending burner with its nozzles projecting outwardly of said upper chamber. A control means is positioned beneath the burner for controlling gas delivery to said burner. A gas take-off head extends downwardly at the bottom of the burner from said common partition, said gas take-off head having an annular sealing member and a coaxial finger. The lower chamber receives a pressure gas fuel container which is connected with said gas take-off head in a gas-tight position and will be perforated by said finger with an upward pressure for the escape of the gas fuel to said burner. An open end is provided at the bottom of the casing for easy access to said casing.

A flexible springy member is disposed across the open end, with one end thereof movably attached thereto and the, other end of the flexible member being contractible when said flexible member is bent upward and capable of being in releasable attachment relative to said open end in its extending position so as to clamp the gas fuel container with an upward pressure.

It is preferably to construct the casing in the form of a vertical axis cylindrical container and to make it with a plastic material by injection molding. In an aspect of the invention, the flexible member is made of two metal bars springily coupled together in a lengthwise alignment. This coupling can be advantageously achieved by pivoting the two metal bars with a spring loaded pin.

In another aspect of the invention, one end of the flexible bar is pivoted to the open end and other end thereof is releasably held by a fastener, in the form of a transverse projection provided at the edge of the open end.

An object of the invention is to provide a gas firing apparatus having its housing open at the bottom end thereof for access to the housing and a clamping member provided across the open end to clamp the gas cartridge against an annular sealing member to establish a gas tight connection by fastening the clamping member at the open end, thereby improving the clamping action of the apparatus as well as avoiding the leakage of the gas when taking off the lid from the housing.

Another object of the invention is to provide a gas firing apparatus with a flexible clamping member that can force the gas cartridge against the finger to perforate a gas vent and offer a clearance between the finger and gas vent by its flexible manner so as to allow the gas cartridge to slightly withdraw from the finger.

BRIEF DESCRIPTION OF THE DRAWINGS

These and other objects, features and advantages of the present invention will become more apparent from the following description of a preferred embodiment with reference to the accompanying drawings, in which.

DETAILED DESCRIPTION OF THE PREFERRED EMBODIMENT

Figure 1:
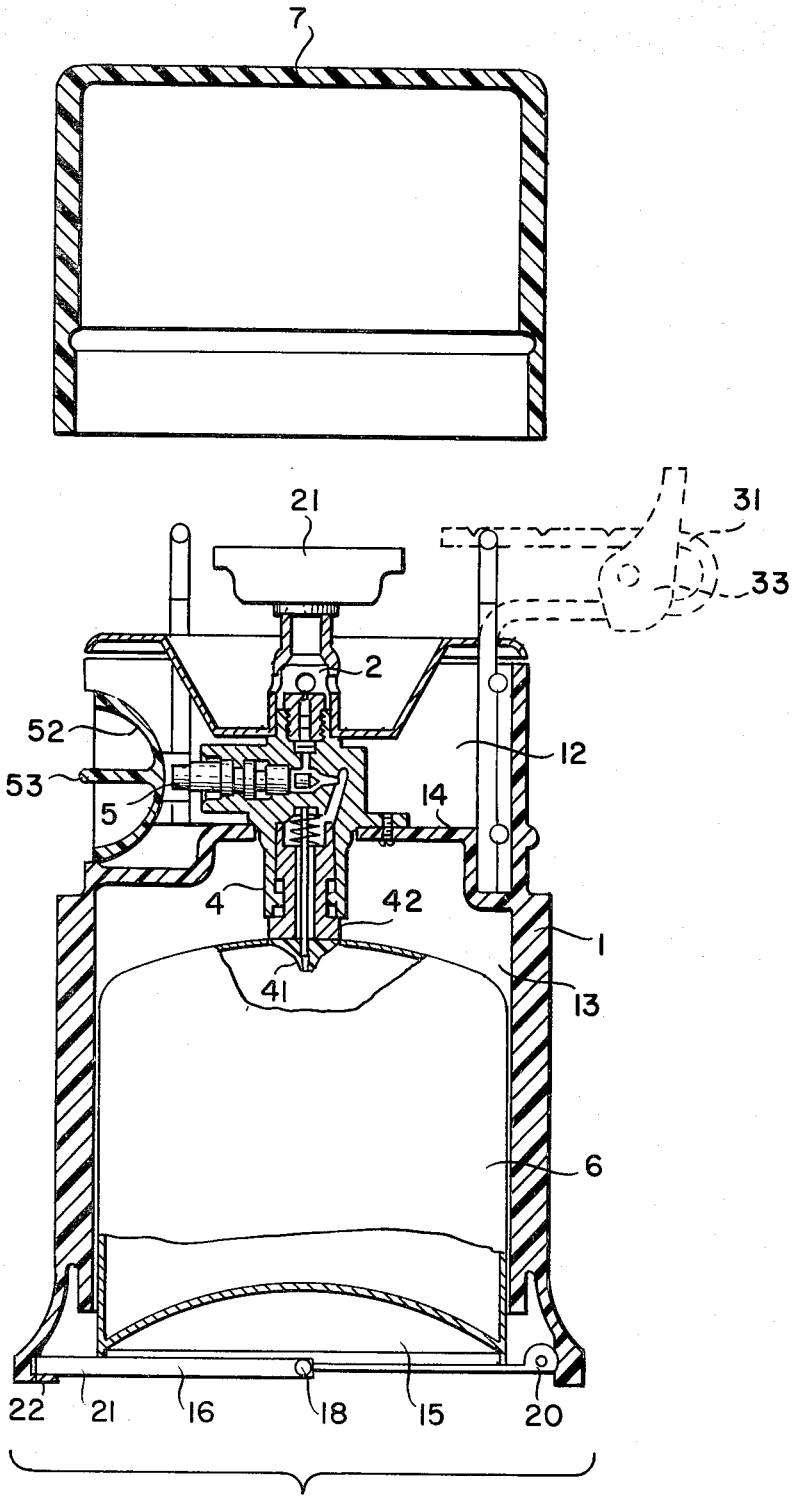
FIG. 1 is a sectional view of a gas firing apparatus constructed according to the invention.
Figure 2:
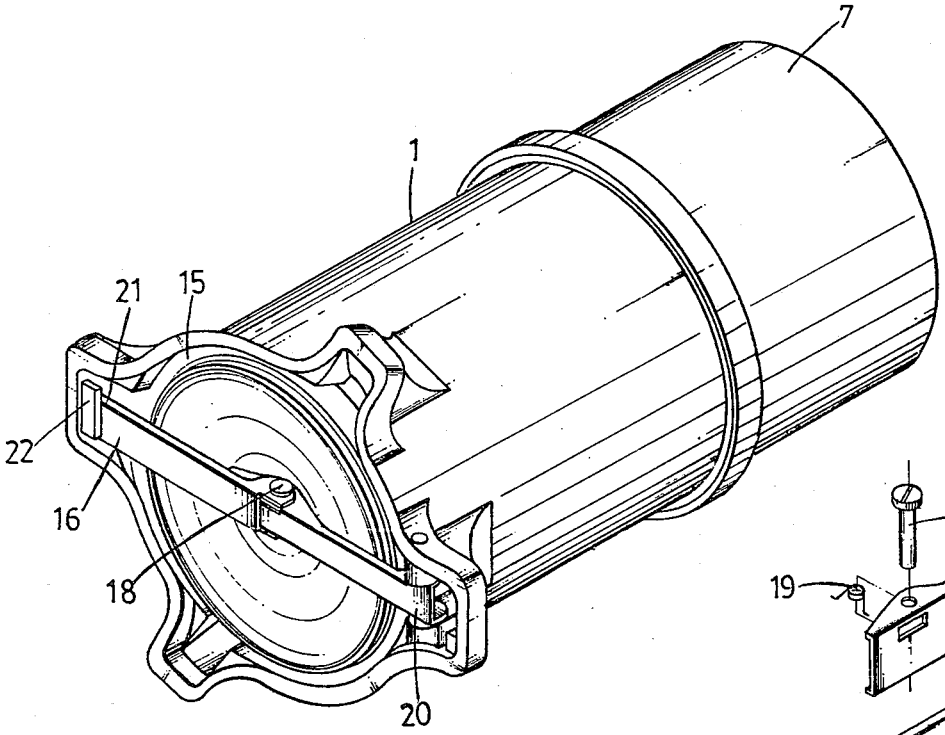
FIG. 2 is a perspective view of a gas firing apparatus constructed according to the invention.

As shown in FIGS. 1 & 2 a gas firing apparatus according to the invention is fitted up with a vertical axis container 1 having two chambers 12 & 13, one disposed above the other, divided by a common partition 14 that passes across the container. A lid 7 covers the container 1 and is engaged therewith at a level substantially the same as the common partition 14. A burner 2 extends upwardly from the common partition 14 with a nozzle portion 21 projected outwardly from the upper chamber 12. A plurality of supports 31 are provided around the burner's nozzle portion 21 for supporting a food container. Each support 31 is formed of an elongated member rotatably extending from the common partition 14 and is bent to form a U-shape at the top portion thereof which is provided with an adjustable projection 33 movably attached thereto. The position of the projection 33 relative to the U-shaped top portion is adjustable so that any size of food container can be supported and restrained on the supports 31 by adjusting the position of the projection 33 on the U-shaped top portion so as to adjusted to surround the bottom portion of the food container.

An annular gas take-off head 4 downwardly extends from the common partition 14 and include an annular sealing member 41 at its end and a coaxial finger 42 in the form of a spike. A control means 5 is disposed between the burner 2 and the gas take-off head 4 for controlling the flow of gas to the burner 2 and is operated through an operating element which is connected with one end of the control means 5 and constituted by a round dish 52 fitted in the wall of the upper chamber and a diametral cross member 52 used as a rotary control knob for operating the control means 5.

Figure 3:
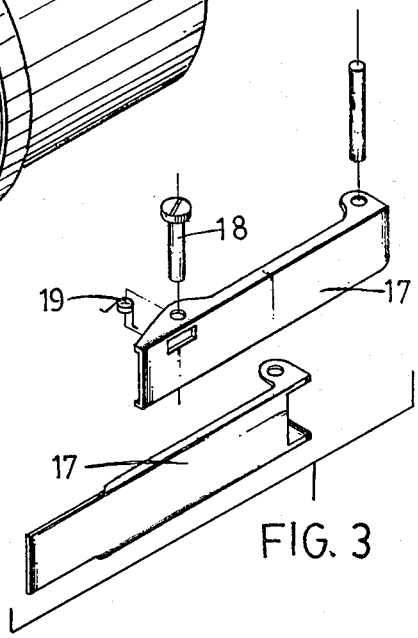
FIG. 3 is an exploded view of a flexible springy clamping member constructed according to the invention.

The lower chamber 13 includes an open end 15 at the bottom thereof through which gas cartridge 6 is positioned. The gas cartridge 6 is in the form of a cylindrical container with its upper end portion and lower end portion being concave. The gas cartridge 6 is guided by the wall of the lower chamber 13 and will be clamped by a flexible springy metal bar 16 provided across the open end 15. The flexible metal bar 16 is formed of two metal bars 17 coupled together in a lengthwise alignment by pivoting with a pin 18 loaded with a spring 19, as shown in FIG. 3. One end 20 of the flexible bar 16 is pivoted to the open end 15, and the other end 21, during the clamping position of the flexible bar 16, is held by a fastener 22 in the form of a projection provided at the open end to prevent the end 21 from moving away from the open end 15.

It will be noted that the two bars 17 overlap at the joint 18 so that the flexible bar 16 can only be bent upward by an upward pressure and will become rigid when it is in a straight line position. The end 21 is contractible and extendible due to the bendable action of the flexible bar 16. When the flexible bar 16 is pushed to bend upward the gas cartridge 6 will be clamped against the annular sealing member 41 and the finger 42 and then perforated by the finger 42, and at the same time the end 21 is contractedly moved in the open end and passes over the fastener 22. After releasing the pushing force the flexible bar becomes rigid and the end 21 extends to fall into engagement with the fastener 22. At that time the gas cartridge 6 is held clamped with its perforated gas vent slightly withdrawn from the finger 42 and still in gas-tight connection, with the annular sealing member 41 being slightly resilent from its compressed position caused by the pushing force, established by an upward pressure of the clamping bar 16.

With the invention thus explained, it is apparent that obvious modifications and variations can be made without departing from the scope of the invention. It is therefore intended that the invention be limited only as indicated in the appended claims.

What I claim is:

1. A portable gas firing apparatus for cooking, heating, etc. having a casing, a common partition dividing said casing into two chambers with one disposed above the other, a burner extending upwardly from the common partition of said two chambers with a nozzle projecting outwardly of said upper chamber, a control means being provided beneath said burner for controlling gas delivery to said burner, a downwardly extending gas take-off head being provided at the bottom of said burner from said common partition, said gas take-off head having an annular sealing member and a coaxial finger, the lower chamber receiving a pressure gas fuel container which is connected with said gas take-off head in a gas-tight position and being adapted to be perforated by said finger with an upward pressure for the escape of gas fuel to said burner through said gas take-off head, wherein the improvement comprises, an open end provided at the bottom of said casing for easy access to said casing, a flexible springy member having a first and second end being disposed across said open end with the first end thereof movably attached thereto, and the second end of said flexible member being contractible when said flexible member is bent upward and capable of being in releasable attachment relative to said open end in its extending position so as to clamp said gas fuel container with an upward pressure, said flexible springy bar being formed by two aligned bars springily coupled together and further including a spring loaded pin, said two bars being pivotally coupled together by said spring loaded pin and further including a fastener member, said releasable attachment being formed by an engagement between said second end and said fastening member which can release said second end in the bending position of said flexible member at said open end to prevent said second end from moving away from said open end.

2. A portable gas firing apparatus for cooking, heating, etc. having a casing, a common partition dividing said casing into two chambers with one disposed above the other, a burner extending upwardly from the common partition of said two chambers with a nozzle projecting outwardly of said upper chamber, a control means being provided beneath said burner for controlling gas delivery to said burner, a downwardly extending gas take-off head being provided at the bottom of said burner from said common partition, said gas take-off head having an annular sealing member and a coaxial finger, the lower chamber receiving a pressure gas fuel container which is connected with said gas take-off head in a gas-tight position and being adapted to be perforated by said finger with an upward pressure for the escape of gas fuel to said burner through said gas take-off head, wherein the improvement comprises, an open end provided at the bottom of said casing for easy access to said casing, a flexible springy member having a first and second end being disposed across said open end with the first end thereof movably attached thereto, and the second end of said flexible member being contractible when said flexible member is bent upward and capable of being in releasable attachment relative to said open end in its extending position so as to clamp said gas fuel container with an upward pressure, said flexible springy bar being formed by two aligned bars springily coupled together and further including a spring loaded pin, said two bars being pivotally coupled together by said spring load pin for properly positioning the pressure gas fuel container relative to the coaxial finger to ensure proper escape of the gas therefrom.

3. A portable gas firing apparatus as claimed in claim 2, and further including a fastening member, said releasable attachment being formed by an engagement between said second end and said fastening member which can release said second end in the bending position of said flexible member at said open end to prevent said second end from moving away from said open end.

* * * * *